United States Patent [19]

Dominguez

[11] 4,084,778

[45] Apr. 18, 1978

[54] BRACKET FOR SUPPORTING STRINGED MUSICAL INSTRUMENTS

[76] Inventor: Richard Lee Dominguez, 3835 W. Eva Ave., Phoenix, Ariz. 85021

[21] Appl. No.: 734,342

[22] Filed: Oct. 20, 1976

[51] Int. Cl.[2] ..... A47F 5/00

[52] U.S. Cl. ..... 248/314; 248/300; 248/289 R; 248/443

[58] Field of Search ..... 248/314, 300, 289, 312, 248/110, 443, 248, 509; 211/66, 60 T; 24/262

[56] References Cited

U.S. PATENT DOCUMENTS

| | | | |
|---|---|---|---|
| 936,104 | 10/1909 | Ernest | 248/289 |
| 1,597,659 | 8/1926 | Hoerr | 248/300 X |
| 3,192,894 | 7/1965 | Staver | 248/314 X |
| 3,463,870 | 8/1969 | Eucker | 24/262 X |
| 3,765,633 | 10/1973 | Caudill | 248/229 |

FOREIGN PATENT DOCUMENTS

| | | | |
|---|---|---|---|
| 778,206 | 7/1957 | United Kingdom | 248/309 R |

*Primary Examiner*—Roy D. Frazier
*Assistant Examiner*—Peter A. Aschenbrenner
*Attorney, Agent, or Firm*—Cahill, Sutton & Thomas

[57] ABSTRACT

A bracket for hanging objects such as guitars, basses, and similarly shaped objects, the bracket including a coplanar mounting section, an upwardly angling mid-section, and a forward section including opposing jaws defining an orifice with a constricted mouth, the object is hung in a vertical configuration seated within the orifice.

4 Claims, 4 Drawing Figures

BRACKET FOR SUPPORTING STRINGED MUSICAL INSTRUMENTS

BACKGROUND OF THE INVENTION

This invention relates to a bracket for hanging objects; specifically brackets for use in conjunction with hanging musical instruments such as guitars or basses.

Stationing of musical instruments on the band stand when not in use represents a real problem to the musician. Band stands often provide relatively little floor space, especially for today's musician who must count among his equipment not only the musical instrument itself but various electrical parphernalia such as amplifiers, speakers, and the like. Little space is left to store the instrument itself, especially bulky, fragile instruments such as guitars, basses, and other stringed instruments with fretted necks. At the present time, floor stands are provided to station such instruments when not in use. Floor stands of course further reduce available floor space, and even the expensive, heavy duty models are prone to being tipped over with consequent damage to the instruments. Other disadvantages of floor stands are the storage space they require when not in use and the time and effort required for setting up and tearing down.

It is a primary object of this invention to provide a device for stationing or securing objects in place when not in use. In particular, it is an object of this invention to provide a stand for musical instruments which conserves floor space.

A further object is a bracket or stand which can be located in a convenient, unobstrusive position on a band stand.

A further object is to provide a low cost, easily mountable, stable device for securely and stationarily holding a fretted neck, stringed instrument in proximity to the musician during a performance.

BRIEF DESCRIPTION OF THE DRAWINGS

Drawings are provided, wherein:

Referring to FIGS. 1 and 2, bracket 10 is composed of three sections, a first section 12, a second section 14, and a third section 16. Section 12 is flat, coplanar and is fitted with a centrally located aperture 18 for receiving a screw 19 or other suitable element for attaching the bracket to a suitable flat surface such as is provided by a cabinet housing electrical equipment such as an amplifier. Forward of aperture 18 and along the parallel sides of the bracket within first section 12 are directly opposing, matching notches 20 which serve to align the bracket 10 with a line transverse to the longitudinal axis of the bracket. Preferably, this transverse line is provided by the leading edge of the top of a cabinet to which the bracket 10 is mounted, as will be explained hereinafter.

Figure 1:
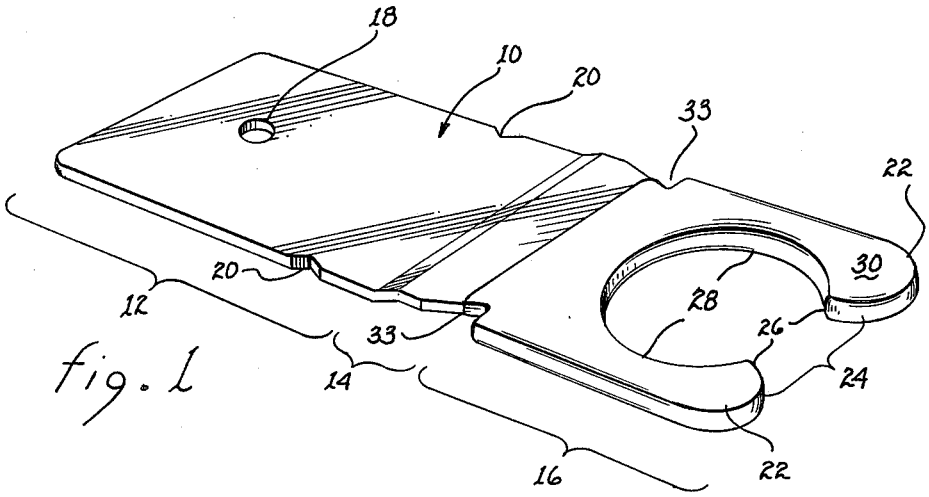
FIG. 1 is a perspective view of the bracket of this invention.
Figure 2:
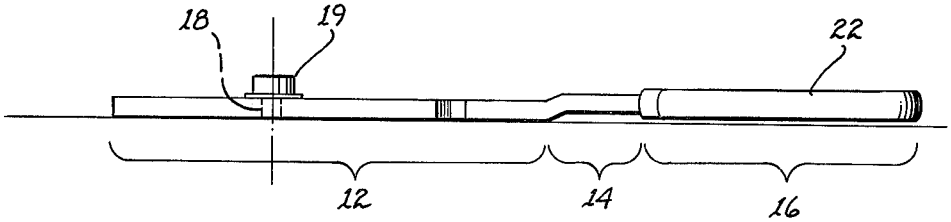
FIG. 2 is a side elevational view of the bracket of the invention.

Forward of first section 12 and integral therewith is second section 14 which extends angularly upward from first section 12. Extending from second section 14 is third section 16 which is in parallel, elevated relationship to first section 12. Third section 16 includes opposing curved jaw members 22 which define therebetween an orifice 24. Orifice 24 includes a neck portion 26 which communicates with semi-circular shaped main portion 28 of orifice 24.

Neck portion 26 provides an entrance of restricted cross-wise dimension to main portion 28. Jaw members 22 have a smooth, relatively soft surface preferably provided by a coating 30 of a plastic resin for purposes hereinafter explained. Coating 30 preferably occurs over the entire surface of the jaw members 22 but may be restricted to the underside of the jaw members 22 as well as the opposing surfaces of the jaw members defining orifice 24. Coating 30 extends rearward toward second section 14 post notches 33 in opposing sides of bracket 10. Notches 33 serve to anchor coating 30 to bracket 10.

Figure 3:
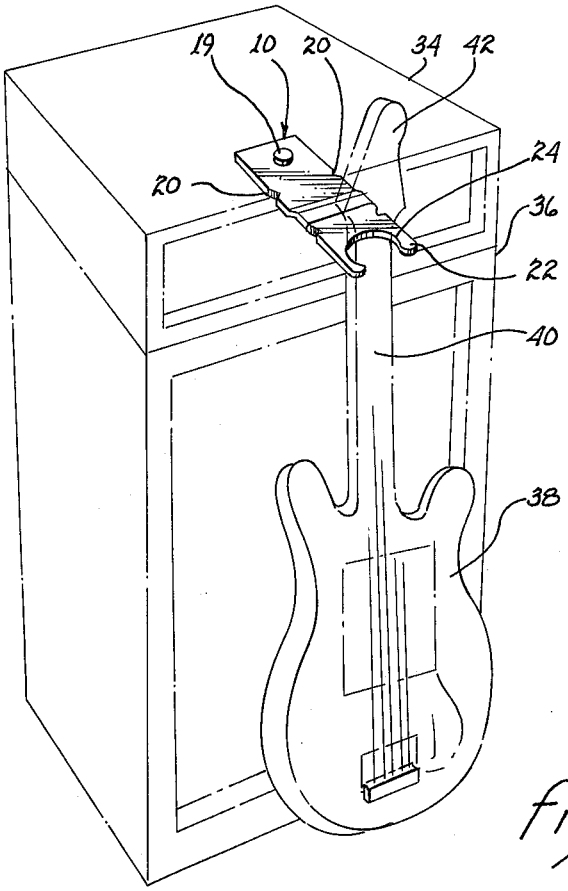
FIG. 3 is a perspective view showing the bracket of the invention mounted on a cabinet and holding a stringed instrument.

In FIG. 3, bracket 10 is mounted by screw 19 on the top 34 of cabinet 36. Bracket 10 is positioned so that notches 20 are aligned with the leading edge of cabinet 36. Hanging from bracket 10 is a guitar 38. Neck 40 of guitar 38 is located within orifice 24 with enlarged portion 42 of neck 40 seated on the opposing proximate edges jaw members 22. To insert neck 40 in orifice 24, the guitar 38 is turned sideways so that neck 40 can pass through neck portion 26 of orifice 24. The major dimension (width) of neck 40 is greater than the cross-wise dimension of neck portion 26 but the thickness of neck 40 is less than the cross-wise dimension of neck portion 26 in order that entry into orifice 24 can be effected. Further, the depth of main portion 28 is greater than the width of neck 40 so that the guitar 38 can be turned to orient guitar 38 as shown in FIG. 3 once the neck 40 has fully entered main portion 28. Because of the stability of cabinet 36, there is little chance that cabinet 36 will be tipped over on the band stand with consequent damage to guitar 38. Similar, the configuration of orifice 24 is such that guitar 38 can not be inadvertantly removed from bracket 10.

Figure 4:
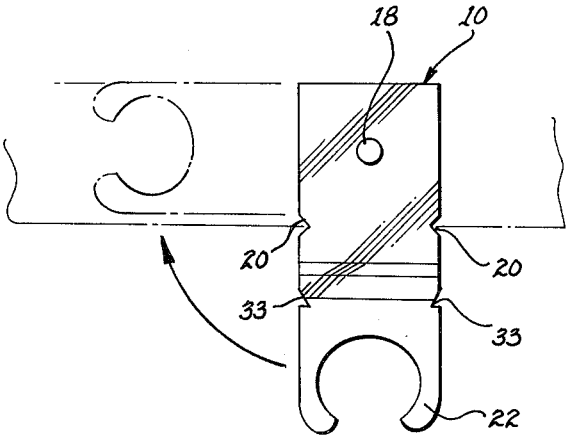
FIG. 4 is a plan view wherein the bracket is pivoted to a stored position when not in use.

In FIG. 4, bracket 10 is pivoted from its extended position to a position where it resides within the bounds of the edge of cabinet 36. To facilitate pivoting, a slip washer is preferably interposed between the head of screw 19 and the top of bracket 10. By having the third section 14 elevated with respect to first section 12, the third section 16 including the extra thickness provided by coating 30 will clear the edge and surface of cabinet 36. The purpose of coating 30 is to prevent marring of the cabinet surface as well as marring of the instrument or other object held by the bracket 10.

The bracket may suitably be made of one-eighth inch (0.3 cen.) thick T-6 aluminum stock although other metal or rigid plastic materials may be employed. In the case of a metal being used, the third section, or at least those portions thereof which will be in contact with the instrument of the cabinet when pivoted to the stored position should preferably be coated with a plastic, e.g. by dipping the bracket into hot vinyl, which will adhere to the metal and will provide a smooth, soft, non-marring surface. If the bracket is made of a rigid plastic material, such a coating or other suitable covering such as felt or the like is not necessary as the inherent qualities of the plastic will prevent marring. This invention has been described with respect to a preferred embodiment, it being understood that variations and modifications thereof may be made without departing from the object and scope of the invention.

What is claimed is:

1. A bracket to be secured to a cabinet for hanging musical instruments therefrom comprising a rigid member having a first substantially flat coplanar section, a second section integral with said first section and extending angularly upwardly from said first section, and a third substantially flat coplanar section integral with and extending from said second section and in parallel, elevated relationship to said first section, said first, second, and third sections being in mutual alignment, said first section including a centrally located aperature for receiving attachment means to pivotally attach said bracket to the top of said cabinet, said third section comprising opposing coplanar curved jaw members having a smooth, relatively soft surface, said jaw members defining an orifice between said jaw members, said orifice comprising a neck portion and a main portion, said neck portion providing a constricted exterior entrance to said main portion.

2. The bracket of claim 1 wherein said first section includes directly opposing aligning means on opposing sides of said first section for aligning said bracket along a line transverse to the longitudinal axis of said bracket, said bracket being pivotable to a position within the bounds of the edge of the top of said cabinet when said opposing aligning means is aligned with the edge of said cabinet.

3. The bracket of claim 2 wherein said smooth, relatively soft surface is provided by a plastic coating adherably bonded to said jaw members of said bracket.

4. The bracket of claim 3 wherein said third section includes notch means on opposing sides of said third section for anchoring said coating on said bracket.

* * * * *